US005599202A

United States Patent [19]

Key

[11] Patent Number: 5,599,202

[45] Date of Patent: Feb. 4, 1997

[54] STRAIN RELIEF ELECTRICAL CONNECTOR

[75] Inventor: Edward Key, Palmyra, Pa.

[73] Assignee: Electrical Wiring Device Company, Inc., Blue Bell, Pa.

[21] Appl. No.: 589,511

[22] Filed: Jan. 22, 1996

[51] Int. Cl.[6] ..... H01R 13/58

[52] U.S. Cl. ..... 439/459; 439/395; 439/462

[58] Field of Search ..... 439/459, 404, 439/417, 418, 452, 462, 274, 275, 395

[56] References Cited

U.S. PATENT DOCUMENTS

| | | | |
|---|---|---|---|
| 3,624,591 | 11/1971 | Buberniak | 439/459 |
| 4,178,056 | 12/1979 | Lee | 439/459 |
| 5,305,547 | 4/1994 | Weiss | 439/395 |
| 5,439,388 | 8/1995 | Weiss et al. | 439/417 |

*Primary Examiner*—David L. Pirlot
*Assistant Examiner*—T. C. Patel
*Attorney, Agent, or Firm*—Caesar, Rivise, Bernstein, Cohen & Pokotilow, Ltd.

[57] ABSTRACT

An electrical plug or receptacle for securement to an end of an electrical cable having plural insulated electrical wires. The connector comprises a front housing having a longitudinal axis, a rear housing, a termination block, a strain relief keeper, and plural zero gap insulation displacement terminals. The two housings are movably secured to each other by screw threads so that when secured together they form a hollow interior chamber for receipt of the cable end. The insulation displacement terminals are located within the front housing section and each includes a tined-portion extending into the interior chamber. The termination block is located within the interior chamber and is adapted to receive and hold portions of the electrical wires contiguous with the free ends thereof for electrical engagement by the insulation displacement terminals. The strain relief keeper is a cup-shaped member located within the interior chamber and coupled to the termination block to hold the free end portions of the electrical conductors therein for engagement by the insulation displacement terminals and to tightly engage respective portion of the conductors' insulation to prevent the cable from being pulled out of the connector. A ratchet locking mechanism is provided to hold the two housings together.

22 Claims, 5 Drawing Sheets

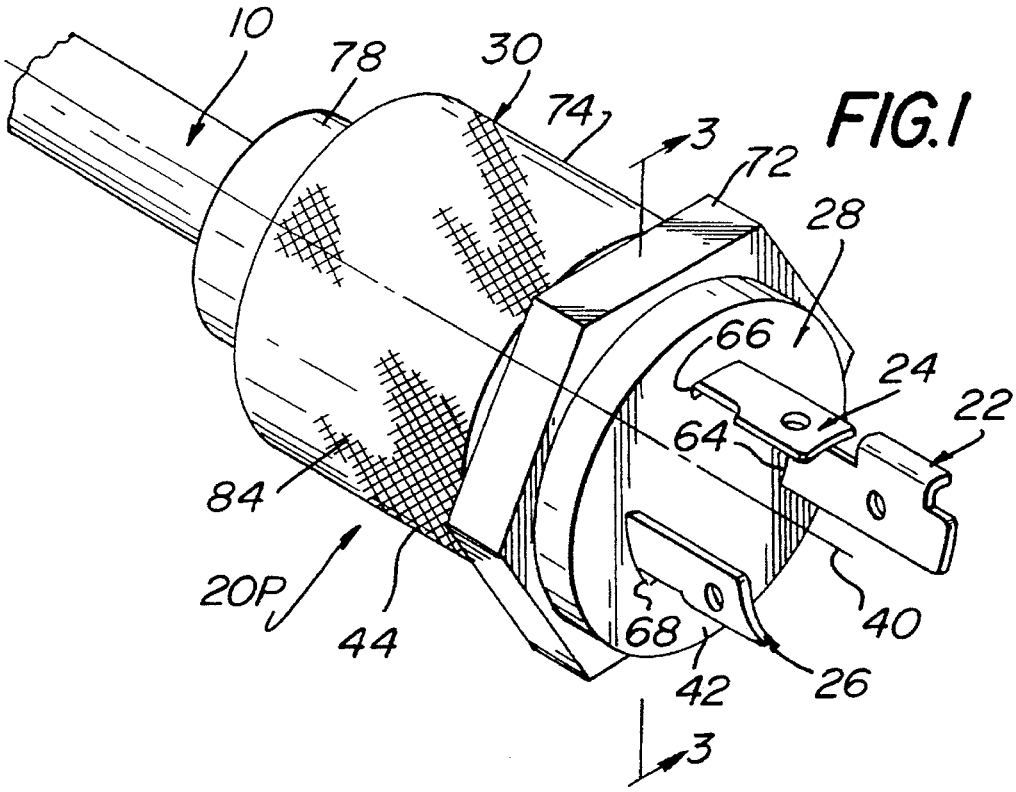
FIG.1
FIG.3
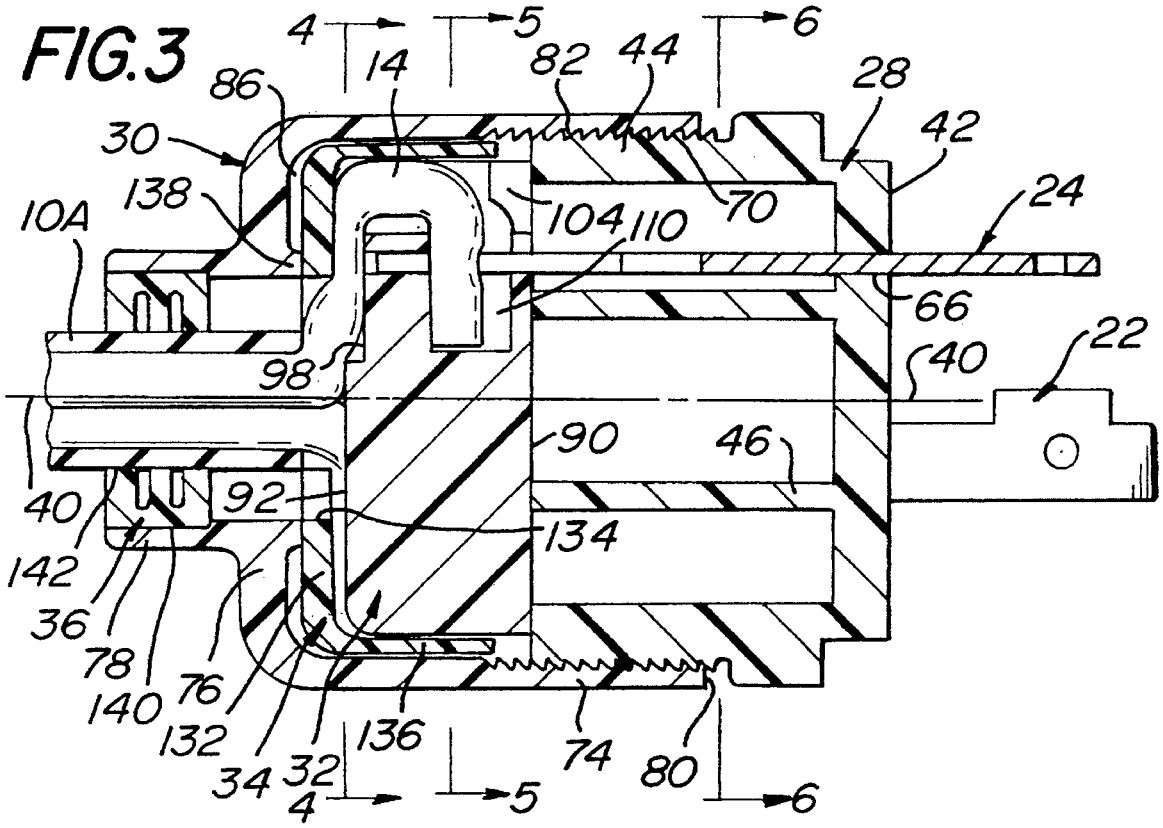

STRAIN RELIEF ELECTRICAL CONNECTOR

BACKGROUND OF THE INVENTION

The invention relates generally to electrical connectors, and more particularly to electrical connectors, e.g., plugs, receptacles, etc., for multi-conductor cables including means for relieving strain on the electrical conductors. Electrical plugs are used to connect electrical machinery to an electrical power source. These plugs come in a large variety of sizes and configurations. They generally are constructed of thermoplastic, e.g., type "6/6 Nylon" housing parts which are excellent electrical insulators, and metal, e.g., yellow brass, plug and connection parts, which are excellent conductors.

Until now, almost all plug manufacturers used a similar method of conductor termination. In particular, the wires are stripped of insulation at their free ends. Each of the stripped wire ends is placed between two metal plates, one of which constitutes part of the electrical terminal. One of the metal plates is movable toward the other by tightening of an associated screw. Thus, the bare wire end can be tightly sandwiched between the plates in good electrical continuity therewith by tightening of the screw.

As will be appreciated by those skilled in the art these metal plates are so stiff that the principal energy storage mechanism is the conductor itself, and these conductors, being soft copper, are not very good at storing energy. To compensate for this poor energy storage mechanism, the screws must be tightened on a regular basis, in order to maintain a good electrical connection.

Another important part of a conventional plug is the use of means for ensuring strain relief, e.g., to prevent the conductor from being pulled from the plug. Prior art strain relief mechanisms have usually taken the form of clamps to prevent a pulling force on the electrical connections, when pulling on the cable. In particular, almost all commercially available plug strain relief members squeeze the cable between the main plug housing and a plastic plate. Generally, self-tapping screws are used. These screws go through clearance holes in the plate and screw into the main housing.

This arrangement is somewhat complex and entails the use of a high component count, e.g., a relative large number of components are used to form the clamp.

Thus, there is a need for an electrical connector which enables the termination of plural insulated electrical wires and which provides good strain relief in a simple, low-component count assembly.

OBJECTS OF THE INVENTION

It is a general object of this invention to provide an electrical connector which addresses those needs.

It is a further object of this invention to provide an electrical connector utilizing at least one insulation displacement terminal for terminating at least one insulated electrical conductor and for automatically providing strain relief therefor.

It is a further object of this invention to provide an strain relieving electrical connector which is simple in construction.

It is a further object of this invention to provide an strain relieving electrical connector which includes a low component count.

It is a further object of this invention to provide an strain relieving electrical connector which can be assembled easily and quickly without special tools or techniques.

It is a further object of this invention to provide an strain relieving electrical connector which, once assembled, is resistant to accidental loosening.

It is a further object of this invention to provide an strain relieving electrical connector which, once assembled, is resistant to the ingress of moisture or foreign material therein.

SUMMARY OF THE INVENTION

These and other objects of this invention are achieved by providing an electrical connector, e.g., a plug or receptacle, for securement to at least one electric conductor, e.g., an insulated wire of a multi-wire cable. The conductor wire is covered with insulation and terminates at a free end for securement to the electrical connector.

The electrical connector basically comprises a front housing member, a rear housing member, a termination block, a strain relief keeper member, and at least one electrically conductive terminal. The front housing member has a longitudinal axis. The rear member is adapted to be releasably secured, e.g., screwed, to the front member to form an interior chamber therebetween for receipt of a portion of the electric conductor therein generally parallel to the longitudinal axis.

The termination block is located within the interior chamber and is adapted to receive and hold a portion of the electric conductor contiguous with the free end thereof in a generally U-shaped configuration having a pair of leg sections extending generally perpendicularly to the longitudinal axis and an intermediate section located between the pair of legs and extending generally parallel to the longitudinal axis.

The strain relief keeper member is located within the interior chamber and is coupled to the termination block to hold the free end portion of the electrical conductor in the termination block, and to tightly engage a portion of its insulation to prevent the electrical conductor from being pulled out of the termination block.

The electrically conductive terminal is secured to the front housing member and includes a front portion arranged to be electrically engaged by another electrically conductive member and a rear portion extending into the interior chamber. The rear portion of the electrically conductive terminal is adapted to be electrically connected to the electrically conductive wire of the electrical conductor.

In accordance with one preferred aspect of this invention the termination block comprises a front face, a rear face, and a side face. The front face and the rear face are each generally planar and extend perpendicularly to the longitudinal axis. The rear face of the termination block has a groove therein extending perpendicularly to the longitudinal axis for receipt of one of the leg sections of the U-shaped end of the electrical conductor. The side face of the termination block has a bore extending therein perpendicularly to the longitudinal axis for receipt of the other of the leg sections of the U-shaped end of the electrical conductor, and also has a slot therein extending parallel to the longitudinal axis. The slot is arranged to receive the inter-mediate section of the U-shaped end of the flexible electrical conductor.

In accordance with another preferred aspect of this invention the strain relief keeper member is a generally cup-shaped member having a generally planar front wall having an opening therein and a peripheral flange extending about the front wall. A portion of the electrical conductor extends through the opening in the strain relief keeper member and a portion of its front wall tightly engages the portion of the insulation of the electrical conductor located within the groove in the termination block to prevent the electrical conductor from being pulled out of said electrical connector.

In accordance with yet another preferred aspect of this invention the termination block includes a channel extending generally parallel to the longitudinal axis for receiving the rear portion of the electrically conductive terminal. That terminal preferably is an insulation displacement terminal, e.g., a zero gap or clearance insulation displacement terminal, which is arranged to be pierce through the insulation of the electrical wire when the front and rear housing sections are connected together.

DESCRIPTION OF THE DRAWINGS

Other objects and many attendant advantages of this invention will become readily appreciated as the same becomes better understood by reference to the following detailed description when considered in connection with the accompanying drawings wherein:

FIG. 1 is an isometric view of one embodiment of an electrical plug constructed in accordance with this invention;

FIG. 3 is an enlarged sectional view taken along line 3—3 of FIG. 1;

DETAILED DESCRIPTION OF THE PREFERRED EMBODIMENTS

Figures 2, 8:
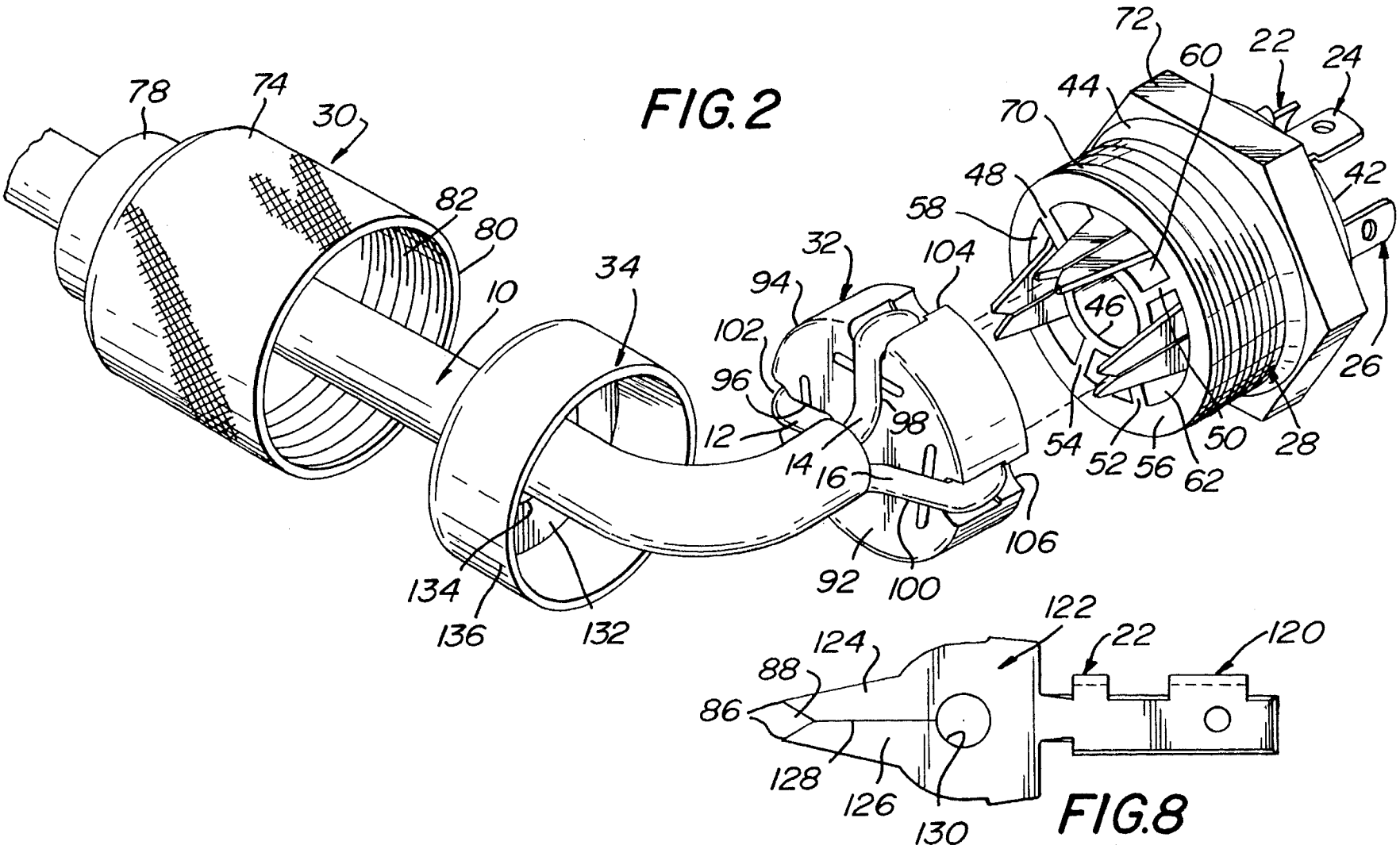
FIG. 2 is an exploded isometric view of the electrical plug shown in FIG. 1.
FIG. 8 is a plan view of one insulation displacement terminal used in the plug of FIG. 1.

Referring now to various figures of the drawing where like reference numerals refer to like parts there is shown at 20P in FIG. 1 one embodiment of an electrical connector constructed in accordance with this invention. The connector 20P is in the form of a plug for terminating (i.e., being electrically connected to) the end of an electrical conductor, e.g., a cable 10 having an insulating jacket 10A (FIG. 3) thereon.

Figure 4:
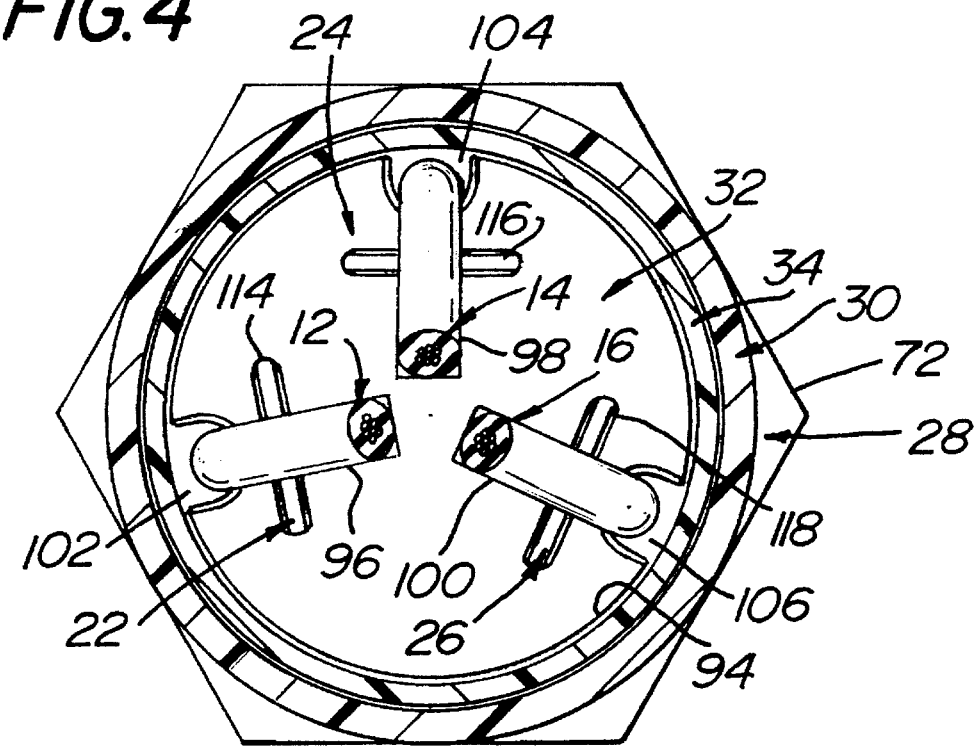
FIG. 4 is an enlarged sectional view taken along line 4—4 of FIG. 3.
Figure 5:
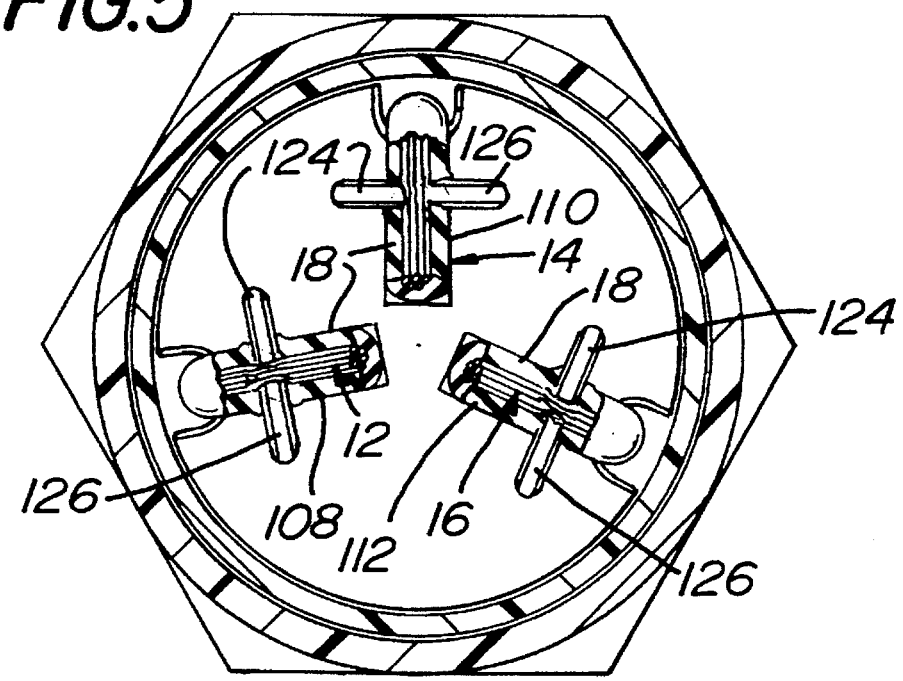
FIG. 5 is an enlarged sectional view taken along line 5—5 of FIG. 3.

In the embodiment of the invention shown herein the cable 10 includes three electrical conductors or wires 12, 14, and 16 (FIGS. 4 and 5). Each of the wires is insulated by electrical insulation jacket or covering 18 and may be a single strand or multiple strands of any suitable electrically conductive material, e.g., copper. The plug 20P constitutes a three terminal, 480 volt, 30 ampere plug which is arranged to be matingly received in a receptacle or socket 20R (shown in FIG. 7) also constructed in accordance with this invention. Thus, the receptacle 20R is also arranged for terminating the end of an electrical conductor, e.g., a cable 10.

It should be pointed out at this juncture that the plug 20P and receptacle 20R as shown and described herein are merely exemplary of the many types of electrical connectors which can be constructed in accordance with this invention. Moreover, the plugs and receptacles of this invention can be used with any type of electrical conductor having at least one electrically conductive wire covered by a insulation jacket.

Figure 9:
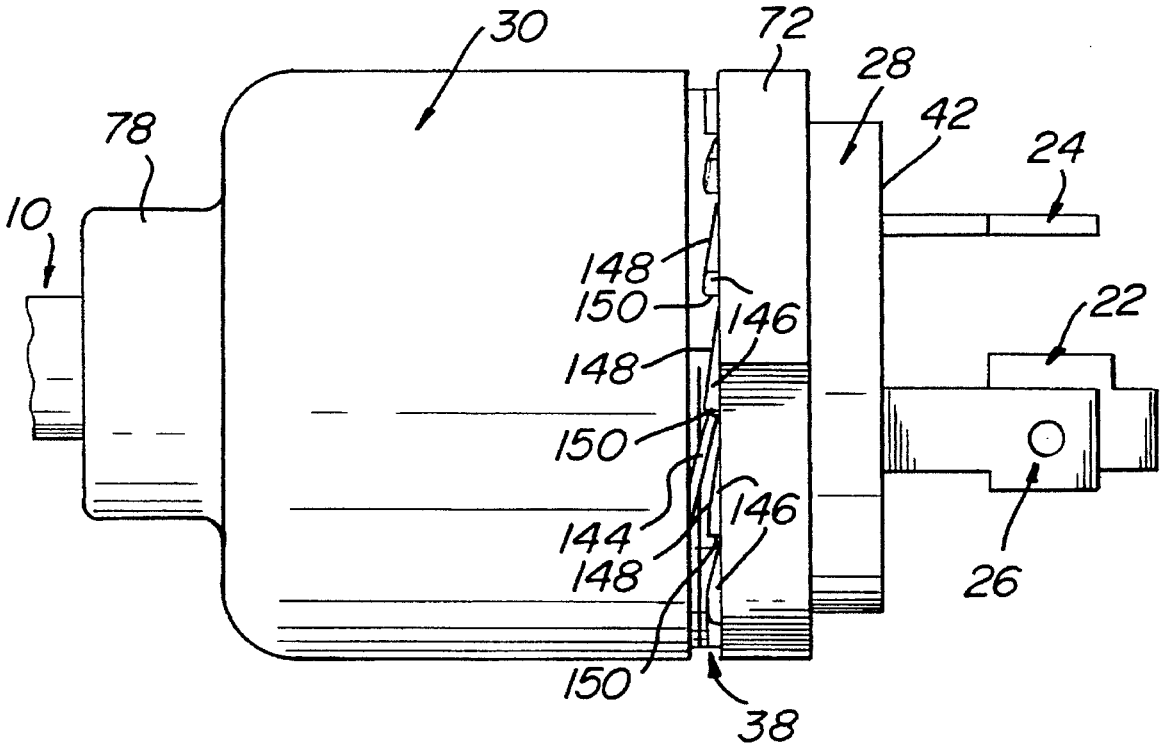
FIG. 9 is a side elevational view of the plug of FIG. 1 and showing a locking mechanism for holding the two housing components of the plug together against accidental disconnection.

As will be appreciated from the discussion to follow the plug 20P and the receptacle 20R are each a low-component count device, as compared to the prior art. For example, the plug 20P is made up of only nine components, namely, three insulation displacement terminals 22, 24, and 26, a front housing member or section 28, a rear housing member or section 30, a termination or wiring block 32, a strain relief keeper member 34, a wire-seal or gasket 36, and a locking mechanism 38 (FIG. 9). Moreover, of those nine components, two of which, namely, the gasket 36 and the locking mechanism 38, may be considered to be optional. Comparable prior art plugs for electrical connection to a three insulated wire cable 10 use considerably more components. Moreover, since the plug and receptacle of this invention make use of insulation displacement connectors or terminations, the number of components which must be formed of electrically conductive metal is kept to an absolute minimum, e.g., the terminals themselves. Thus, the plug and/or receptacle of this invention is simpler in construction, and can be assembled with greater economies than the prior art.

Figure 6:
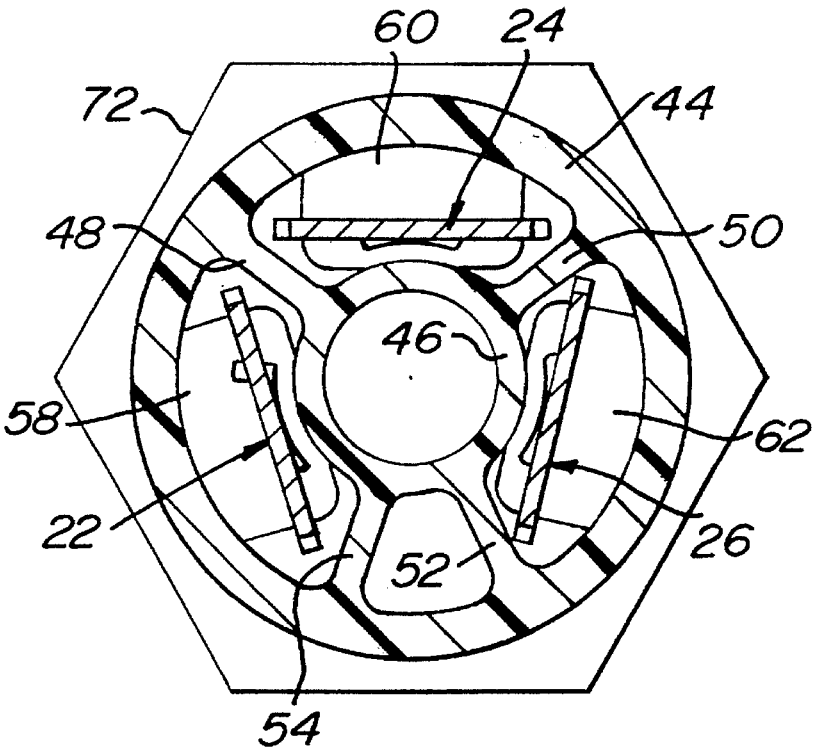
FIG. 6 is an enlarged sectional view taken along line 6—6 of FIG. 3.

As can best be seen in FIGS. 1–3 the front housing section 28 is a generally cylindrical, hollow, member having a longitudinal axis 40. The front housing section 28 is formed of any suitable rugged electrically insulative material such as used in prior art electrical connectors, e.g., nylon, and includes a circular side wall 44 extending about the axis 40 and a generally planar front wall 42 extending perpendicularly to the axis 40. A central circular partition wall 46 (FIG. 6) is concentrically located within the side wall 44. Four generally planar partition walls 48, 50, 52, and 54, project outward from the central partition wall 46 to the side wall 44. The partition walls 46–54 extend longitudinally from the front wall 42 of the front housing section 28 to the planar rear edge 56 thereof and form between them respective passageways through which portions of respective insulation displacement terminals 22, 24, and 26 extend. In particular, the partition walls 46, 48 and 54 and a portion of the side wall 44 form a passageway 58 therebetween for accommodating a portion of the insulation displacement terminal 22. The partition walls 46, 48 and 50 and a portion of the side wall 44 form a passageway 60 therebetween for accommodating a portion of the insulation displacement terminal 24. The partition walls 46, 50 and 52 and a portion of the side wall 44 form a passageway 62 therebetween for accommodating a portion of the insulation displacement terminal 26.

As can be seen clearly in FIG. 1, the front wall 42 of the front housing section includes slots 64, 66, and 68 which communicate with the passageways 58, 60, and 62, respectively, and through which portions of the insulation displacement terminals 22, 24, and 26, respectively, extend. The terminals are fixedly secured in place within those slots.

As can be seen clearly in FIGS. 2 and 3 the outer surface of the front housing section's side wall 44 contiguous with the rear edge 56 includes an external helical thread 70 thereon for mating engagement with an internal thread (to be described later) on the rear housing section 30. The portion of the side wall 44 closely adjacent the front wall 42 is in the form of a hex-head projection 72 to facilitate the grasping of the front housing section 28 to secure it to the rear housing section 30 (as will be described later).

The rear housing section 30 is also a generally cylindrical, hollow, member formed of the same insulative material as the front housing section and includes a circular side wall 74 extending about the axis 40 and a generally planar rear wall 76 extending perpendicularly to the axis 40. The rear wall includes a flanged central opening 78 through which the axis 40 passes. The inner surface of the side wall 74 contiguous with the planar front edge 80 includes an internal helical thread 82 thereon for mating engagement with the external thread 70 on the front housing section 28 so that the two housing sections can be screwed together. In order to facilitate the grasping of the rear housing section 30 to effect the securement, e.g., screwing, of it to the front housing section the outer surface of the side wall 74 of the rear housing section is knurled at 84. In lieu of the knurled surface 84, the outer surface of the rear housing section may be fluted (not shown), or of some other shape to facilitate the grasping of the rear housing section 30 during the assembly of the plug.

When the two housing sections 28 and 30 are screwed together they form a hollow interior chamber 86 (FIG. 3) therebetween into which the free end of the electrical cable 10 is extended for connection of its conductors 12, 14, and 16, to the insulation displacement terminals 22, 24, and 26, respectively. The electrical connection between the cable's conductors 12, 14, and 16, and those terminals is effected via the termination or wiring block 32. To that end the termination block 32 is located within the chamber 86 and is arranged for receiving and holding the free end portions of the cable's conductors and for receiving insulation piercing portions (to be described later) of the terminals 22, 24, and 26, so that those portions pierce through the insulation 18 on each of the conductors to make electrical contact with the conductor wire therein.

As can be seen clearly in FIGS. 2–5 the termination or wiring block 32 basically comprises a generally circular, disk-like member formed of a strong, electrically insulative material. In one preferred embodiment of this invention the material is LEXAN so that it is transparent to enable one to see the position of the conductors 12, 14, and 16 within the block to facilitate their placement therein. The block 32 includes a generally planar front face 90 (FIG. 3), a generally planar rear face 92, and a circular side face 94. The front and rear faces of the block 32 each extend generally perpendicular to the longitudinal axis 40 when the termination block is within the chamber 86 and the two housing sections 28 and 30 are screwed together.

As best seen in FIG. 2 the rear face 92 of the termination block includes three grooves 96, 98, and 100 extending from the center of the rear face radially outward to the outer face of the termination block. Each of the radially extending grooves is of semi-circular cross-section in order to receive a portion of a respective insulated conductor of the cable 10 adjacent the free end thereof. In particular, the groove 96 is adapted to receive a portion of the insulated wire 12 adjacent its free end. In a similar manner, the groove 98 is adapted to receive a portion of the insulated wire 14 adjacent its free end. Similarly, the groove 100 is adapted to receive a portion of the insulated wire 16 adjacent its free end. The depth of each of the grooves 96–100 is less than the outer diameter of the insulation 18 on the free end portions of the conductor wires 12–16 so that when the conductor wires with the insulation thereon are within those grooves they extend beyond the plane of the end face 92 of the termination block 32, as shown in FIG. 3 (for reasons to be described later).

The circular side face 94 of the termination block 32 also includes three slots 102, 104, and 106 contiguous with the grooves 96, 98, and 100, respectively. Each of the slots extends parallel to the longitudinal axis 40 and is arranged to receive another portion of the wires 12–16 closer to their free ends than the portion within the grooves 96–100. As can be seen clearly in FIGS. 4 and 5, three bores 108, 110, and 112 extend radially inward from the slots 102,104, and 106, respectively, for receipt of the free ends of the wires 12, 14, and 16, respectively.

The termination block 32 also includes three longitudinally extending linear slots 114,116, and 118. These slots are arranged to receive the insulation piercing ends (to be described later) of the insulation displacement terminals 22, 24, and 26, and extend from the front face 90 of the termination block 32 to the rear face 92 thereof. The termination receiving slots 114, 116, and 118 intersect the radially extending bores 108, 110, and 112, respectively and also intersect the radially extending grooves 96, 98, and 100 respectively.

Attention is now directed to FIG. 8 wherein one of the insulation displacement terminals of this invention, namely terminal 22, is shown. That terminal is preferably of the zero clearance type and is formed of any suitable electrically conductive material, e.g., brass, etc. The terminal 22 basically comprises a front end portion in the form of a projection or prong 120 adapted to be received in a slot in a mating receptacle, e.g., the receptacle 20R (or any other receptacle such as a conventional receptacle), and a rear end portion 122. The rear end portion 122 constitutes the insulation piercing portion of the terminal 22. The other terminals 24 and 26 are similarly constructed to terminal 22, except for the shape of their prong portions. Thus, the rear or insulation piercing portion 122 of each of the terminals 22, 24, and 26 is of identical shape.

In the interests of brevity, only the termination 22 will be described in detail herein. As can be seen the rear portion 122 of the terminal 22 is a generally planar member in the form of a rearwardly directed pair of pointed tines 124 and 126. Since the terminal is of the "zero clearance" type the tines meet each other along a longitudinally extending interface or slit 128. The slit 128 of the terminal 22 is arranged to receive the conductor 12 therein, i.e., the tines spread apart slightly, whereupon the inner edges of the tines contiguous with the slit 128 dig into and cut through the insulation 18 to electrically engage the conductor wire 12. In a similar manner the tines 124 and 126 of the terminals 24 and 26, cut through the insulation 18 to electrically engage the wires 14 and 16, respectively, as shown clearly in FIG. 5.

As can be seen in FIG. 8, the inner end of the slit 128 of each terminal merges with a large central hole 130. The hole 130 provides stress relief to prevent damage to the terminal when its tines 124 and 126 spread apart to receive the electrical wire in the slit 128.

The free end 86 of each of the tines 124 and 126 is tapered and pointed to form a V-shaped entrance 88 (FIG. 8) to facilitate the insulation displacement or cutting action by the terminal when the plug 20P is assembled. In particular, when the conductors 12–16 are located and held within the termination block 32, and the front housing section 28 screwed onto the rear housing section 30, the pointed free ends 86 of the terminals 22, 24 and 26 enter into the slots 114, 116, and 118, respectively. Each conductor fits into the V-shaped entrance of its associated insulation displacement terminal so that the edges of the tines 124 and 126 engage the insulation on the conductor portions held within the radially extending bores 108, 110, and 112, whereupon those tine edges begin to cut into the insulation 18 thereon. Continued screwing of the housing sections together forces the insulation displacement terminals 22, 24, and 26 deeper into the slots 114, 116, and 118 and through the insulation on the conductors within the radially extending bores 108, 110, and 112, until the edges of the tines electrically engage the wires of the conductors, as shown clearly in FIG. 5.

The details of the strain relief keeper member 34 will be described in detail shortly. Suffice it for now to state that the strain relief keeper member 34 cooperates with the termination block 32 to hold portions of the electrical conductors 12, 14, and 16 contiguous with the free ends thereof within the termination block so that those conductors can be electrically engaged by the insulation displacement terminals, as just described. In addition the strain relief keeper member 34 also provides automatic strain relief for the plug 20P or receptacle 20R in which it is located. In particular, the strain relief keeper member 34 tightly engages a portion of the insulation 18 on those conductors to prevent them from being pulled out of the termination block. This dual action is shown clearly in FIG. 3, and is accomplished by the termination block 32 cooperating with the strain relief keeper member 34 to receive and hold a portion of each of the electric conductors 12–16 contiguous with the free end thereof in a generally U-shaped configuration. In particular, each generally U-shaped configuration comprises a pair of leg sections extending generally perpendicularly to the longitudinal axis and an intermediate section located between the pair of legs and extending generally parallel to the longitudinal axis. One of the legs of the U-shaped free end portion of each conductor is located within an associated radially extending bore in the terminal block, while the other of the legs of the U-shaped free end portion of that conductor is located within an associated groove in the rear face of the terminal block, and the intermediate section of the U-shaped free end portion of that conductor is located within an associated slot in the side face of the terminal block. The remaining portion of the conductor extends generally parallel to the longitudinal axis 40 of the plug 20P and out through the flanged opening 78 in the rear housing section 30.

As can be seen in FIGS. 2 and 3 the strain relief keeper member 34 is a generally cup-shaped member having a generally planar wall 132 having a central opening 134 therein and a peripheral flange or side wall 136 extending about the planar wall. The keeper member 34 is formed of the same electrically insulative material as the housing sections 28 and 30 and is located within the chamber 86 within those housing sections when they are screwed together. In particular, the keeper member is arranged to be located within the chamber 86 with its peripheral flange 136 surrounding the side face 94 of the termination block 32 to hold the U-shaped end portions of the conductors 12, 14, and 16 within the termination block as the front and rear housing sections 28 and 30, respectively, are screwed together. A portion of the flexible electrical cable 10 extends through the opening 134 in the keeper member and out through the flanged opening 78 in the rear housing section.

When the two housing sections 28 and 30 are tightly screwed together, an annular projection 138 (FIG. 3) on the inner surface of the rear housing section applies pressure to the outer surface of the planar wall of the keeper member 34 contiguous with the opening 134, whereupon the keeper member is pushed in the direction towards the terminal block 32. This action causes the inner surface of the planar wall 132 of the keeper member 34 to tightly engage the portions of the insulation 18 of the electrical conductors 12, 14, and 16 within the grooves 96, 98, and 100, respectively, of the terminal block as shown clearly in FIG. 3. Accordingly, the electrical conductors are prevented from being pulled out of the assembled plug 20P. This action automatically provides the desired strain relief for the plug.

The hex head projection 72 on the front housing section 28 enables that section to be tightly grasped, e.g., by a pliers or other suitable tool, while the knurling 84 on the rear housing section 30 enables that section to be manually grasped by a user's hand. Thus, the two housing sections can be readily screwed together to the desired degree of tightness to effect the electrical interconnection of the terminals 22, 24, and 26 to the conductors 12, 14, and 16.

In order to seal the interior of the plug from the ambient surroundings at the point where the cable 10 exits the rear housing section 30, i.e., at the flanged opening 78, to prevent moisture or foreign matter from gaining ingress into the plug 20P the heretofore identified seal or gasket 36 is provided. That gasket basically comprises a ring-like member formed of any suitable material, e.g., rubber, and is adhesively secured in place on a ledge 140 (FIG. 3) within the flanged opening 78. The cable 10 extends through a central opening 142 in the gasket or seal 36.

In order to prevent the two housing sections 28 and 30 from becoming accidentally disconnected, the heretofore identified locking mechanism 38 is provided. That mechanism is in the form of a ratchet and is best seen in FIG. 9. Thus, as can be seen therein the locking mechanism 38 basically comprises a generally planar metal spring tab 144 and a plurality of cooperating teeth 146. The spring tab 144 is fixedly secured to the front edge 80 of the rear housing section 30, e.g., molded in situ, so that a free end portion extends outward at an acute angle to a plane perpendicular to the longitudinal axis 40. The teeth 146 are each wedge shaped with a ramp surface 148 extending at an acute angle to a plane perpendicular to the longitudinal axis 40 and a stop surface 150 extending parallel to that axis. The teeth 146 are preferably integrally molded in the rear edge surface of the hex-head projection 72 of the front housing section 28 and are disposed immediately adjacent one another. The tab 144 is arranged to slide up the ramp surface 148 of one tooth 146 into the space between that tooth the next tooth and then over the ramp surface of that next tooth, and so on as the two housing sections are screwed together. As should thus be appreciated by those skilled in the art, each time that the tab 144 slides over one tooth 146 and into the space between it and the next tooth the two housing sections 28 and 30 are precluded from being unscrewed, since the free end of the tab will engage the stop surface 150 of the last tooth which over which it had just slid. Thus, when the two housing sections are screwed together to the desired degree of tightness to accomplish a good electrical interconnection between the insulation displacement terminals and the cable's conductors, while the keeper 34 bears on those conductors to provide the desired strain relief, the two housing sections cannot accidentally loosen.

The electrical termination of the plural insulated wires of the cable 10 by the plug 20P will now be described. The outer jacket of the cable 10 is removed to a gauge length, but the individual conductor wires are not stripped of their insulation 18 at their free ends. Instead the free ends of the wires are placed into radially extending bores in the wiring block 32, bent around the edge of the wiring block into the slots therein and then bent into the grooves in the face of the wiring block. The keeper member 34 is slid down over the cable and wires to prevent the wires from coming out of the wiring block prior to termination. The wiring block is then placed onto the front housing section with it's protruding insulation displacement terminals. This subassembly, i.e., the wiring block, cable, and keeper member, is then "sandwiched" between the front and rear housing sections 28 and 30. These two housing sections are then screwed together until they can go no further, whereupon the insulation displacement terminals cut through the insulation 18 on the wires 12, 14, and 16 to effect the electrical termination thereof. The tightening of the housing sections also effects automatic strain-relief. In particular, the conductors, as they come out of the associated wiring block bores, proceed to wrap-around the sides of the wiring block in the slots, and then pass over the rearward part of the wiring block into the grooves therein before reaching the jacketed cable, and from there the cable passes out the rear of the plug. This configuration places the wires in the termination force path, so that all of the termination forces (e.g., hundreds of pounds) pass through the wires. This action "squashes" the wires without damaging a single strand. The simple action of screwing the housing sections of the connector together not only terminates the wires, but also strain-relieves them as well, automatically, regardless of conductor or insulation size.

Figure 7:
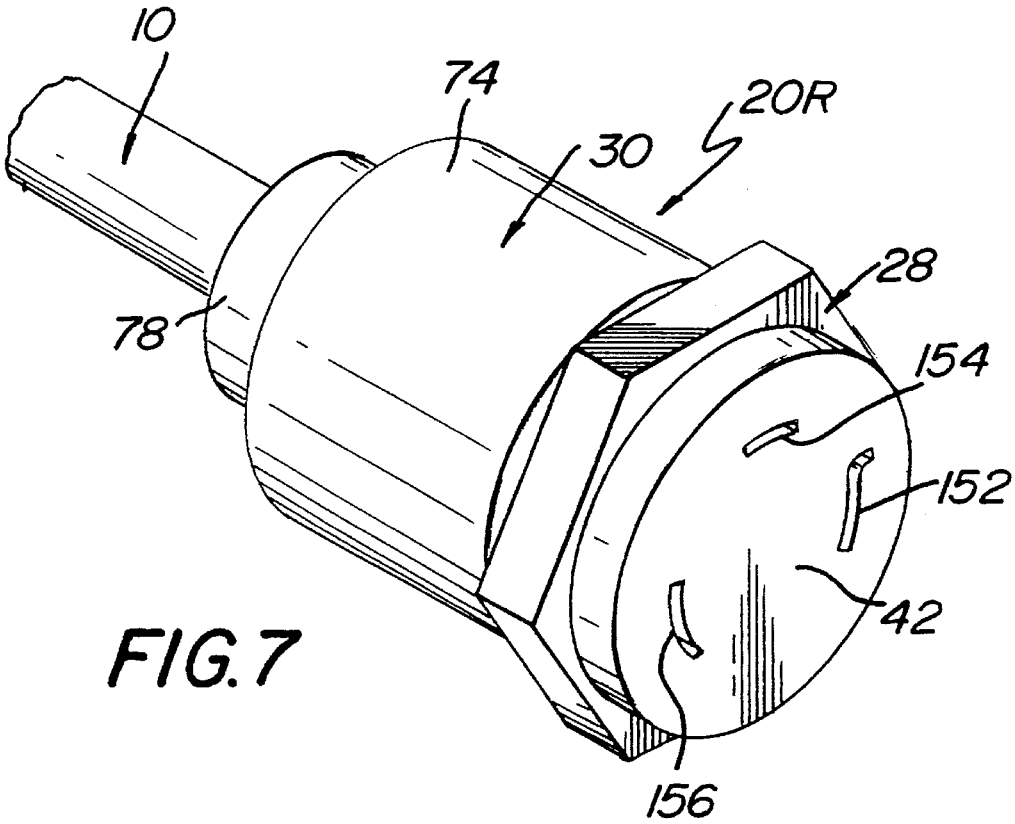
FIG. 7 is an isometric view of one embodiment of an electrical receptacle constructed in accordance with this invention and arranged for mating engagement with the electrical plug shown in FIG. 1.

The receptacle 20R constructed in accordance with this invention is shown in FIG. 7 and is similar in construction to the plug 20P, except that the front housing section includes three slots 152, 154, and 156 into which the prong portions 120 of the terminals 22, 24, and 26 of the plug 20P (or any other plug) will be received when the plug 20 is plugged into the receptacle 20R. The insulation displacement terminals (not shown) of the receptacle 20R are identical in construction to the terminals 22, 24, and 26 except for their forward portions, i.e., the portions which are arranged to mate with the prongs of a plug inserted into the receptacle. To that end the portions of the receptacle's insulation displacement terminals which connect to the cable wires 12, 14, and 16 are identical to the portions 120 of the terminals 22, 24, and 26. The front portions of the receptacle's terminals are shaped differently to the prong portions 120 of the plug's terminals 22, 24, and 26. In fact, the front portions of the receptacle's terminals are constructed to mate with the prong portions of the plug's terminals within the slots 150, 152, and 154.

As will be appreciated from the foregoing the since the connectors of this invention use insulation displacement terminals, and in particular, zero gap terminals, the connectors are capable of terminating a wide range of wire sizes in a single connector design. In the exemplary embodiment disclosed herein the connector can terminate 8 through 20 awg wire. Moreover, the insulation displacement terminals cooperate with the wiring-block to make electrical termination very easy.

The assembly of the connector at the factory so that it is ready for use can be accomplished much more readily and inexpensively than prior art connectors due to various factors. For example, for a three conductor plug/receptacle only 3 metal parts, i.e., the terminals, are required. This should be compared to comparable prior art plugs/receptacles which use significantly more metal components, e.g., eight screws, three terminals, three plates, and one rivet. The only factory assembly of the connector of this invention which is required is pressing the three terminals into the housing section 28. This sub-assembly and the other plastic parts are then placed into a sealed bag for provision to the user who then completes the assembly to terminate a cable.

Other advantages of the plug/receptacles of this invention are the ability to terminates a wide range of about seven wire gages with a single design, while providing for automatic strain relief. Moreover, very little twisting force need be applied to the housing sections 28 and 30 to screw them together, e.g., 5 to 10 pounds, yet such twisting force generates the linear high force needed for the insulation displacement terminals to pierce through the conductor insulation, e.g., approximately 500 pounds or more. Thus, the connectors of the subject invention provide the user with a quick and easy means of terminating one or more insulated electrical conductors. Moreover, once the conductor/cable is terminated virtually no maintenance is required since the two housing sections 28 and 30 are locked together against accidental loosening. This should be contrasted to almost all prior art connectors which require periodic screw-tightening to keep their housing sections together. Lastly, the connectors of this invention can be made in the same size as prior art devices to meet all industry standards and can be used on virtually every plug and receptacle configuration.

It should be pointed out at this juncture that the housing sections 28 and 30 of the connectors of this invention can be secured together via other means than the screw threads shown and described heretofore. Thus, any mechanism can be utilized to enable the two housing sections to be brought together to effect the termination of the conductor wires and to enable the keeper member to provide the automatic strain relief. Moreover, any mechanism can be utilized to hold the two housing sections together once the termination and strain relief have been accomplished.

Without further elaboration the foregoing will so fully illustrate my invention that others may, by applying current or future knowledge, adopt the same for use under various conditions of service.

I claim:

1. An electrical connector for securement to at least one electric conductor having an electrically conductive wire with insulation thereon, said at least one electric conductor being a flexible member terminating at a free end, said electrical connector comprising:

(a) a front housing member having a longitudinal axis;

(b) a rear housing member adapted to be releasably secured to said front member to form an interior chamber therebetween for receipt of a portion of the electric conductor oriented generally parallel to said longitudinal axis;

(c) a termination block located within said interior chamber and being adapted to receive and hold an end portion of the electric conductor contiguous with the free end thereof so that said end portion is generally U-shaped having a pair of leg sections extending generally perpendicularly to said longitudinal axis and an intermediate section located between the pair of leg sections and extending generally parallel to said longitudinal axis;

(d) a strain relief keeper member located within said interior chamber and coupled to said termination block to hold the end portion of the electrical conductor in said termination block, and to tightly engage a portion of the insulation on the electrically conductive wire to prevent the electrical conductor from being pulled out of said electrical connector; and (e) at least one electrically conductive terminal secured to said front housing member, said at least one electrically conductive terminal having a front portion and a rear portion, said front portion being arranged for electrical engagement by another electrically conductive member, said rear portion extending into said interior chamber for electrical connection to the electrically conductive wire of the electrical conductor.

2. The electrical connector of claim 1 wherein said strain relief keeper member is a generally cup-shaped member having a generally planar front wall having an opening therein and a peripheral flange extending about the front wall and wherein a portion of the flexible electrical conductor extends through said opening and a portion of said front wall tightly engages the portion of the insulation of the electrical conductor to prevent the electrical conductor from being pulled out of said electrical connector.

3. The electrical connector of claim 1 wherein said connector comprises an electrical plug.

4. The electrical connector of claim 1 wherein said connector comprises an electrical receptacle.

5. The electrical connector of claim 1 wherein each of said front housing member and said rear housing member is formed of an electrically insulative material.

6. The electrical connector of claim 1 wherein the flexible electrical conductor comprises a cable having plural electrically conductive wires, each of said wires having insulation thereon and terminating at respective free ends, and wherein said electrical connector includes plural electrical terminals secured to said front housing member, each of said electrically conductive terminals having a front portion arranged to be electrically engaged by another electrically conductive member and a rear portion extending into said interior chamber, said rear portion of said electrically conductive terminals being adapted to be electrically connected to respective ones of said electrically conductive wires of the electrical cable.

7. The electrical connector of claim 1 including gasket means mounted in said rear housing member and through which said electrical conductor extends.

8. The electrical connector of claim 1 wherein said electrically conductive terminal is an insulation displacement terminal.

9. The electrical connector of claim 8 wherein said insulation displacement terminal is a zero gap insulation displacement termination.

10. The electrical connector of claim 1 wherein said termination block comprises a front face, a rear face, and a side face, said front face and said rear face each being generally planar and extending perpendicularly to said longitudinal axis, said rear face having a groove therein extending perpendicularly to said longitudinal axis for receipt of one of the leg sections of the U-shaped end of the electrical conductor, said side face having a bore extending therein perpendicular to said longitudinal axis for receipt of the other of the leg sections of the U-shaped end of the electrical conductor, said side face also having a slot therein extending parallel to said longitudinal axis and being arranged to receive the intermediate section of the U-shaped end of the flexible electrical conductor.

11. The electrical connector of claim 10 wherein said strain relief keeper member is a generally cup-shaped member having a generally planar front wall having an opening therein and a peripheral flange extending about the front wall and wherein a portion of the flexible electrical conductor extends through said opening and a portion of said front wall tightly engages the portion of the insulation of the electrical conductor to resist the electrical conductor from being pulled out of said electrical connector, and wherein said flange holds the U-shaped end of the electrical conductor within said slot and said bore.

12. The electrical connector of claim 10 wherein said termination block includes a channel extending generally parallel to said longitudinal axis for receiving said rear portion of said at least one electrically conductive terminal.

13. The electrical connector of claim 12 wherein said electrically conductive terminal is an insulation displacement terminal.

14. The electrical connector of claim 1 wherein said front housing member and said rear housing member are movably secured to each other to enable said housing members to be brought together an operative position, whereupon said insulation displacement terminal pierces through the insulation of the electrically conductive wire at one of said leg sections to electrically engage the electrically conductive wire.

15. The electrical connector of claim 14 wherein said strain relief keeper member is a generally cup-shaped member having a generally planar front wall having an opening therein and a peripheral flange extending about the front wall and wherein a portion of the flexible electrical conductor extends through said opening, said front wall being arranged to tightly engage a portion of the insulation of the electrical conductor when said housing members are in said operative position whereupon said tight engagement prevents the electrical conductor from being pulled out of said electrical connector.

16. The electrical connector of claim 1 wherein said front housing member and said rear housing member are in screw threaded engagement with each other to enable said housing members to be moved relative to each other to change the size of said interior chamber.

17. The electrical connector of claim 16 additionally comprising grasping means located on said front housing member for facilitating the grasping thereof to enable said front housing member and said rear housing member to be readily screwed together.

18. The electrical connector of claim 17 wherein said grasping means comprises a hexagonal shaped surface.

19. The electrical connector of claim 16 additionally comprising grasping means located on said rear housing member for facilitating the grasping thereof to enable said rear housing member and said front housing member to be readily screwed together.

20. The electrical connector of claim 19 wherein said grasping means comprises a grooved surface.

21. The electrical connector of claim 16 additionally comprising locking means for holding said housing members together once they have been screwed together.

22. The electrical connector of claim 21 wherein said locking means comprises a tab projecting from one of said members, and plural teeth in the other of said members, said tab being arranged for engaging one of said teeth when said housing members are screwed together.

* * * * *